United States Patent [19]

Vermot

[11] 4,244,041

[45] Jan. 6, 1981

[54] ELECTRONIC TIMEPIECE WITH AN ALARM DEVICE

[75] Inventor: Michel Vermot, Les Ponts-de-Martel, Switzerland

[73] Assignee: Ebauches Electroniques SA, Marin, Switzerland

[21] Appl. No.: 955,199

[22] Filed: Oct. 27, 1978

[30] Foreign Application Priority Data

Dec. 21, 1977 [CH] Switzerland ..... 17775/77

[51] Int. Cl.[3] ..... G04B 23/02; G04C 21/00

[52] U.S. Cl. ..... 368/73; 368/76; 368/251

[58] Field of Search ..... 58/38 R, 19 R, 57.5, 58/23 R, 23 D, 152 B, 38 A; 368/73, 76, 250, 251

[56] References Cited

U.S. PATENT DOCUMENTS

| | | | |
|---|---|---|---|
| 3,728,855 | 4/1973 | Preiser | 58/38 R |
| 3,931,703 | 1/1976 | Scherrer et al. | 58/85.5 |
| 4,068,461 | 1/1978 | Fassett et al. | 58/23 R |
| 4,152,887 | 5/1979 | Fukuichi | 58/19 R |

*Primary Examiner*—Edith S. Jackmon

*Attorney, Agent, or Firm*—Wender, Murase & White

[57] ABSTRACT

An electronic timepiece with an alarm device, having a digital display unit for indication of the actual time and a memorized time of alarm, and an analog display unit driven by a stepping motor. In such a timepiece, the alarm signal is produced from signals delivered by the frequency divider and is transmitted to an electroacoustic transducer when coincidence exists between the time as measured by the timepiece and the memorized time of alarm. During the signal, the consumption of current is relatively high and is further increased when a driving pulse of the stepping motor is superimposed upon the alarm signal. Such a peak of current is undesirable because the magnetic field produced by the excitation coil of the electroacoustic transducer may disturb the correct functioning of the motor.

A solution to this problem is to shift the alarm pulses in time with respect to the driving pulses so that they never appear simultaneously. To this end, the timepiece includes an electronic circuit which is enabled by an alarm logic circuit, and which receives signals from the frequency divider for delivering an alarm signal, at the time of alarm, such that the alarm signal is shifted in time with respect to the driving pulses of the stepping motor.

6 Claims, 3 Drawing Figures

ELECTRONIC TIMEPIECE WITH AN ALARM DEVICE

BACKGROUND OF THE INVENTION

The present invention concerns an electronic timepiece with an alarm device, having an oscillator, a frequency divider, a stepping motor, at least a display unit, a memory and a comparator for the time of alarm, an alarm logic circuit, a control logic circuit and control means. The display unit, which is for example of the digital type, is used to indicate actual or real time as well as a preselected alarm time. The timepiece may also contain another display unit, which is controlled by a stepping motor of the electromagnetic type. In such a timepiece, an alarm signal is produced from signals delivered by the frequency divider and transmitted to an electroacoustic transducer when the time as measured by the timepiece coincides with a memorized alarm time. During this alarm signal, the consumption of current is relatively high and becomes further increased when a driving pulse appears and is superimposed upon the alarm signal. Such a peak of current is undesirable because it may disturbe the correct functioning of the integrated circuit, and also because the excitation coil of the transducer produces a stronger than normal magnetic field which may cause improper functioning of the motor during operation.

SUMMARY OF THE INVENTION

An object of the present invention is to construct a circuit in which the superposition of the driving pulses of the motor and of the alarm pulses is not possible. To this end, the timepiece comprises an electronic circuit controlled by an alarm logic network and which receives signals furnished by the frequency divider for providing an alarm signal at the time of alarm, said alarm signal being shifted in time with respect to the driving pulses of the stepping motor.

The invention will be described further by way of example, with reference to the accompanying drawings.

DESCRIPTION OF THE PREFERRED EMBODIMENT

Figure 1:
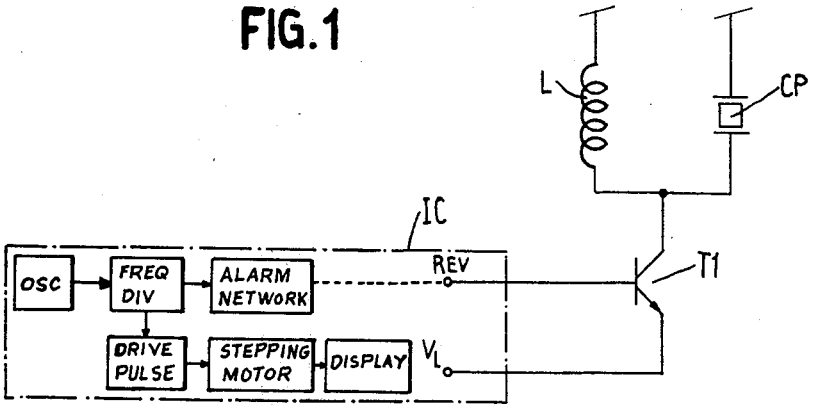
FIG. 1 is a circuit diagram, partially in block form, of a preferred embodiment of an electronic timepiece including an electroacoustic transducer in accordance with the present invention.

FIG. 1 is a schematic diagram showing a circuit for controlling an electroacoustic transducer CP, in which the transducer is, for example, a piezoelectric ceramic element mounted on a membrane. The transducer is connected in parallel with an excitation coil L placed in the collector circuit of a control transistor T1. This transistor is controlled by alarm signals fed to its base electrode from the terminal REV of the timepiece integrated circuit IC. The emitter of T1 is connected, in the integrated circuit, to pole $V_L$ of the timepiece power supply. As shown in FIG. 1, integrated circuit IC includes an oscillator for providing time base pulses to a frequency divider which, in turn, feeds pulses to a drive pulse circuit for actuation of a stepping motor for the timepiece display. The frequency divider also feeds pulses to an alarm network which furnishes the alarm signals to terminal REV.

Figure 2:
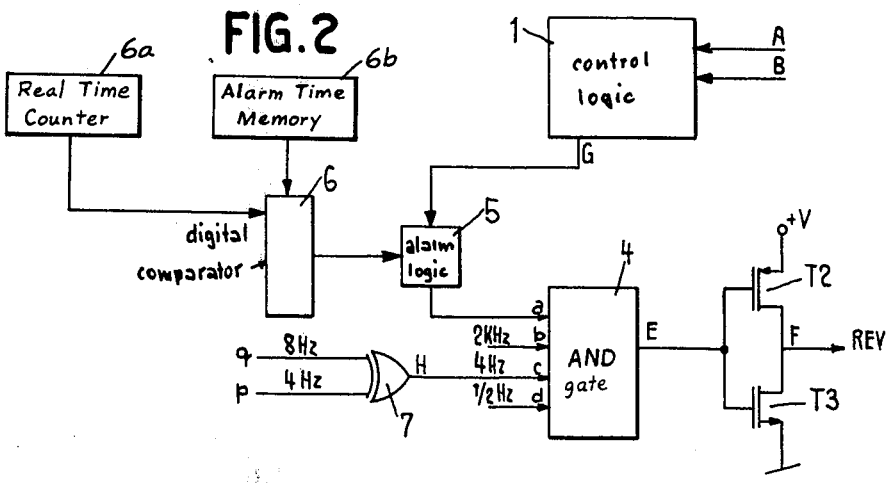
FIG. 2 is a block diagram of the electronic alarm circuit of the timepiece of FIG. 1 according to the present invention.

FIG. 2 is a block diagram of a preferred embodiment of the alarm network of FIG. 1 according to the present invention for producing a shifting of the alarm pulses in time with respect to the driving pulses of the motor. The circuit comprises a control logic circuit 1, controlled by the logic states assumed by the control means A and B, which are, for example push-buttons used to select different functions of the timepiece. The output G of the control logic circuit 1 is connected to a first input of an alarm logic circuit 5. The output of circuit 5 is connected to the input a of an AND gate 4. The second input of the alarm logic circuit 5 is connected to the output of a digital comparator 6. The latter delivers a logic state 1 when coincidence exists between the true time as measured by the timepiece such as by real time counter 6*a*, and a preselected time of alarm which is memorized in the memory 6*b*. The inputs b and d of the gate 4 receive signals of 2048 Hz and 0.5 Hz respectively, which are delivered by the frequency divider (FIG. 1). The input c of gate 4 is connected to the ouput H of an EXCLUSIVE-OR gate 7, which two inputs connected to receive signals of 4 Hz and 8 Hz respectively, delivered by the frequency divider. The output E of gate 4 is connected to the common point of the gate electrodes of an inverter comprising transistors T2 and T3. The output F of the inverter is connected to the terminal REV of the circuit of FIG. 1.

Figure 3:
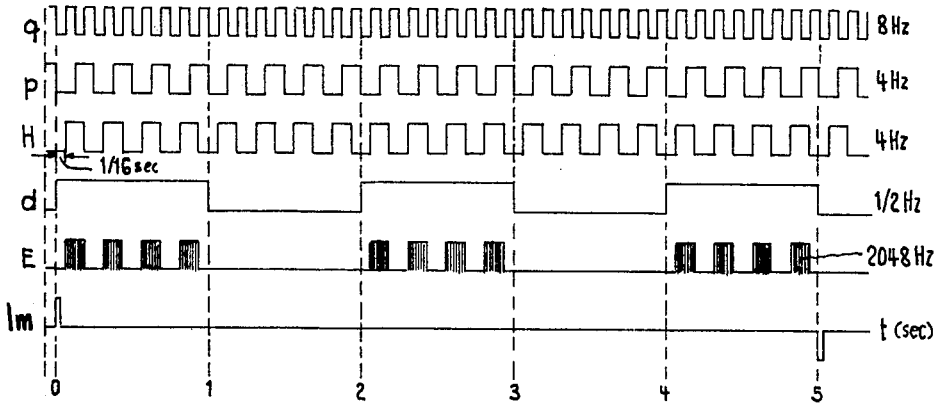
FIG. 3 is a pulse diagram illustrating the signals of the circuit of FIG. 2.

The working mode, explained with reference to the diagram of FIG. 3, is as follows.

When the alarm is switched on, via control means A and B, the timepiece is placed in and the output G of the control logic 1 is in the logic state 1 thereby providing an alarm-on signal. At the moment when the time as measured by the timepiece coincides with the memorized time of alarm, the comparator 6 delivers a logic state 1 or alarm-time signal to the second input of the alarm logic circuit 5. Both inputs of circuit 5 are at the logic state 1 when the alarm is switched on and when the time of the timepiece and that of alarm coincide. In that case, the output of circuit 5, which is connected to the input a of gate 4, is at the logic state 1, which opens or enables this gate. FIG. 3 shows the signals of 4 Hz and 8 Hz, respectively, present at the two inputs of gate 7, and also shows the signal at the output H of the same gate. It can be appreciated that the signal at output H is shifted 1/16 of a second with respect to the input signals and that it has a repetition frequency of 4 Hz. Gate 4 combines the signals of 2048 Hz present at b, of 4 Hz present at c and of 0.5 Hz present at d. The resulting output signal E is shown in FIG. 3. The resulting output signal is the alarm signal which is formed of pulse trains each comprising four pulses of 2048 Hz, each pulse having a duration of $\frac{1}{8}$ of a second, the space between two pulse trains being one second. This alarm signal actuates the electroacoustic transducer CP of FIG. 1 through the inverter comprising the transistors T2 and T3 and the control circuit with the transistor T1 and the coil L.

FIG. 3 shows that the driving pulses Im, which in the described example appear every five seconds to drive the stepping motor and have a duration in the order of 1/125 of a second, never appear simultaneously with the alarm pulses at E. Therefore, the instantaneous current which is delivered by the integrated circuit cannot reach undesirable peak values and the magnetic field of the excitation coil L of the electroacoustic transducer is never present during the functioning of the stepping motor so that the latter is not disturbed. The circuit of FIG. 2 therefore solves the above-described peak current and excessive magnetic field strength problems by shifting of the alarm pulses with regard to the driving pulses to preclude coincidence in time therebetween.

There exist electronic timepieces of the type comprising an alarm device, a stepping motor controlling an analog display unit and a digital display unit which is used to indicate the time as well as the time of alarm. In such a timepiece, as indicated in the U.S. patent application, Ser. No. 955,146 filed on Oct. 27, 1978, owned by the same assignee as in the present application, it is necessary to give to the user of the timepiece an indication of the particular working mode, such as the alarm correcting mode, in which the timepiece is set.Such an indication can be given, as in the above-mentioned application, by an acoustical signal of a short duration having a low repetition frequency, which is switched on when the timepiece is set in the alarm correcting mode. This signal is different from the normal alarm signal and has a low current consumption. However, in such a timepiece there still exists the problem of the simultaneously appearance of the alarm pulses and the driving pulses, which is essentially the same problem solved by the present application. A shifting in time of the alarm pulses with respect to the driving pulses is therefore also desirable. In accordance with the present invention, the desired shifting may be produced by a circuit similar to that disclosed herein.

We claim:

1. In an electronic timepiece having an alarm network and including an oscillator connected to a frequency divider supplying driving pulses to a stepping motor for driving at least one display device, the improvement wherein said alarm network comprises:

control logic means for selectively placing the timepiece in an alarm mode by providing an alarm-on signal;

comparator means coupled to the frequency divider for providing an alarm-time signal at a preselected time of alarm;

alarm logic means coupled to said control logic means and said comparator means and responsive to said alarm-on signal and said alarm-time signal for providing an alarm-enabling signal;

an electroacoustic transducer; and electronic circuit means coupled to said alarm logic means, said frequency divider, and said electroacoustic transducer, said electronic circuit means being responsive to said alarm-enabling signal for delivering to said electroacoustic transducer a train of alarm pulses shifted in time with respect to the driving pulses of the stepping motor such that said alarm pulses do not appear simultaneously with said driving pulses occurring during the presence of said alarm enabling signal.

2. An electronic timepiece having a source of time base pulses and a time display and performing alarm and time-keeping functions; comprising:

an electroacoustic transducer driven by an excitation coil in response to alarm pulses;

a stepping motor for driving the time display;

means coupled to the time base pulse source and said stepping motor for generating driving pulses for said stepping motor; and electronic circuit means coupled to said time base pulse source and the excitation coil of said electroacoustic transducer for generating at a preselected alarm time a train of alarm pulses shifted in time with respect to said driving pulses such that said alarm pulses do not appear simultaneously with said driving pulses during said alarm function.

3. The invention as recited in claim 1, wherein said electronic circuit means comprises an EXCLUSIVE-OR gate and an AND gate the output of which is connected to the input of an inverter, said AND gate being opened by a signal delivered by said alarm logic means when simultaneously the output of said control logic means is at a logic state indicating that the alarm device is switched on and said comparator means delivers a coincidence signal between the time of the timepiece and the time of alarm.

4. The invention as recited in claim 3, wherein said AND gate receives on one of its inputs a signal shifted in time with respect to the driving pulses for the stepping motor and on at least one of its other inputs a signal delivered by the frequency divider, the AND gate combining said signals and delivering at its output said alarm pulses.

5. The invention as recited in claim 4, wherein said signal shifted in time is produced by the EXCLUSIVE-OR gate from at least two signals having different frequencies delivered by the frequency divider.

6. The invention as recited in claim 1, wherein said shift in time of the alarm pulses is greater than the duration of the motor driving pulses.

* * * * *

UNITED STATES PATENT AND TRADEMARK OFFICE

CERTIFICATE OF CORRECTION

PATENT NO. : 4,244,041

DATED : January 6, 1981

INVENTOR(S) : MICHEL VERMOT

It is certified that error appears in the above–identified patent and that said Letters Patent are hereby corrected as shown below:

Title page, left column under the heading "Foreign Application Priority Data", the number "17775/77" should be -- 15 775/77 --.

Signed and Sealed this

*Twenty-eighth* Day of *April 1981*

[SEAL]

*Attest:*

RENE D. TEGTMEYER

*Attesting Officer*

*Acting Commissioner of Patents and Trademarks*